United States Patent [19]

Makhobey

[11] 4,224,703

[45] Sep. 30, 1980

[54] FLUSH TANK VALVE CLOSER

[76] Inventor: Walter Makhobey, 3109 E. Caley Ave., Littleton, Colo. 80121

[21] Appl. No.: 842,547

[22] Filed: Oct. 17, 1977

[51] Int. Cl.[2] ..... E03D 1/30; E03D 3/12

[52] U.S. Cl. ..... 4/324; 4/393; 4/405; 4/DIG. 1

[58] Field of Search ..... 4/324–327, 4/331, 378–382, 393, 395, 396, 401, 405, 1, 384–386, 388, 391, 392, 397, 402, 404, 413, DIG. 1; 251/298; 248/214, 311.1 R; 137/429, 430

[56] References Cited

U.S. PATENT DOCUMENTS

| | | | |
|---|---|---|---|
| 701,548 | 6/1902 | Day | 4/381 |
| 2,168,742 | 8/1939 | O'Neill | 4/401 |
| 2,440,389 | 4/1948 | Anderson, Sr. | 4/324 |
| 2,904,794 | 9/1959 | Goldtrap | 4/399 X |
| 3,012,382 | 12/1961 | Keck | 4/378 X |
| 3,190,611 | 6/1965 | Prescott et al. | 251/298 X |
| 3,438,064 | 4/1969 | Taien | 4/403 |
| 3,918,670 | 11/1975 | Doherty | 248/214 |
| 3,945,056 | 3/1976 | Kowalski | 4/325 |
| 4,017,912 | 4/1977 | Young, Sr. | 4/1 |
| 4,032,997 | 7/1977 | Phripp et al. | 4/324 X |
| 4,038,708 | 8/1977 | Perrine et al. | 4/324 X |

*Primary Examiner*—Stuart S. Levy
*Attorney, Agent, or Firm*—Kyle W. Rost

[57] ABSTRACT

An attachment for closing all varieties of flush valves before the normal amount of water has exited the tank includes a buoyant float that falls with the water level of the tank during a flush and applies its weight against the flush valve to push the valve prematurely into its seat. A float guide rod attaches to the tank wall and provides a path for the float to move upon, and a valve actuator rod is adjustably connected to the float and directly contacts the flush valve. A variety of attachments to the flush valves or actuator rod are provided for reliable performance. A combination of an entire flush valve assembly with a valve closer incorporated in its structure includes a float guide rod attached to the standpipe of the valve assembly rather than to the tank wall.

12 Claims, 14 Drawing Figures

FLUSH TANK VALVE CLOSER

BACKGROUND OF THE INVENTION

1. Field of the Invention

The invention relates to baths, closets, and sinks, and also to fluid handling devices. More specifically, the invention relates to toilet flushing apparatus with means provided to save water. A flush tank attachment is disclosed that fits all varieties of flush valves.

2. Description of the Prior Art

Water saving valves for toilet flush tanks are known in a great variety of embodiments. The following U.S. patents teach flush valves that incorporate means for varying the water delivered by the tank: U.S. Pat. Nos. 1,134,234 to Schonmeyer; 2,001,390 to Lester; 2,106.916 to Morkisch; 2,168,742 to O—Neill et al.; 2,440,389 to Anderson; 2,775,772 to Clarke; 3,561,014 to Johnson; 3,964,109 to Street et al.; and 4,000,526 to Biela et al. The teachings of these prior art patents are uniform in that an entire valve assembly of unique arrangement must be installed in the flush tank. There is no provision for adding a simple device that can convert existing valves to operate in a manner to conserve water. Furthermore, even if some of the above art could be modified to be added to presently existing ordinary flush valves, the applicability of any such art would be limited to a small number of the presently existing types of ordinary flush valves. Therefore, no forseeable apparatus based on the teachings of the prior art could be added to presently existing flush tanks without replacement of the existing flush valve.

My copending application Ser. No. 698,105, filed June 21, 1976, now U.S. Pat. No. 4,091,474 teaches an apparatus that can be added to presently existing flush valves to interrupt the flush. This apparatus attaches to the flush valve and operates by applying its weight to prematurely close the valve at a preselected time. In some flush tanks, however, the complexity of existing linkages, rods, and chains leaves little free area in which to place an attachment to the existing flush valve. Furthermore, there is a possibility that an attachment of the kind described in my copending application or an attachment similar to the devices known in the prior art may interfere with or be interfered with by some portion of the existing flush tank or its contained flush valve, ballcock, or other internal hardware.

From the above review of prior art, it is evident that two major problems presently exist in the prior art. First, presently existing flush valves have a wide variety of configurations that have not been adaptable to any single water saving device without replacing the entire valve. The relatively great expense and inconvenience of replacing an entire valve results in general reluctance to attempt water conservation through reducing the quantity of water used per flush. Alternatively, the availability of a plurality of different devices for modifying correspondingly different existing valves creates confusion and dissuades persons from attempting the job. Second, the variations in the sizes of flush tanks, the variations in available space among mechanisms using the same type of flush valve, and the variety of linkages, rods, chains, and levers that might be found in a flush tank may result in interference between existing mechanisms within the tank and a water saving attachment that may otherwise be well suited for use with the specific type of flush valve found in a tank.

It is therefore the purpose of the present invention to eliminate the above stated problems, while applying the teachings of my copending application.

SUMMARY OF THE INVENTION

A water saving flush valve closer for toilet flush tanks employs a buoyant float that falls with the water level of the tank during a flush and applies its weight to the flush valve in the tank to close the valve before the water level falls to the normal level at which the valve would otherwise close. A float guide rod defines the path that will be followed by the falling float so that the float can operate in the tank without interfering with other mechanisms. An actuator rod is adjustably connected to the float for contacting the flush valve directly from whatever position in the tank the guide rod and float are placed. Various adapters and clips may be used with the actuator rod or flush valve to assure reliable operation of the valve closer with a wide variety of flush valves. A special float, guide rod, and actuator rod are used in combination with an entire flush valve assembly for those instances when replacement of a flush valve is desired.

The main object of the invention is to provide a buoyant float that can prematurely terminate a flush by pushing any known type of flush valve into its seat before the full tank of water has been used. A guide rod that attaches to the flush tank provides a pathway for the float to follow for reliable and accurate operation without interference with the many variations in hardware structure within different flush tanks. The configuration of the float is compact for operation in confined spaces, and an actuator rod connected to the float reaches to the flush valve.

Another object of the invention is to provide a buoyant float in a water saving device wherein air maintains the buoyancy of the float without the float being sealed. Particularly in a molded plastic float where parts of the float must be joined at a union, a tight, permanent seal is difficult to obtain. The present float has the air chamber molded as a unit and joined to a remaining portion of the float by a non-sealed union.

DESCRIPTION OF THE PREFERRED EMBODIMENT

Figure 1:
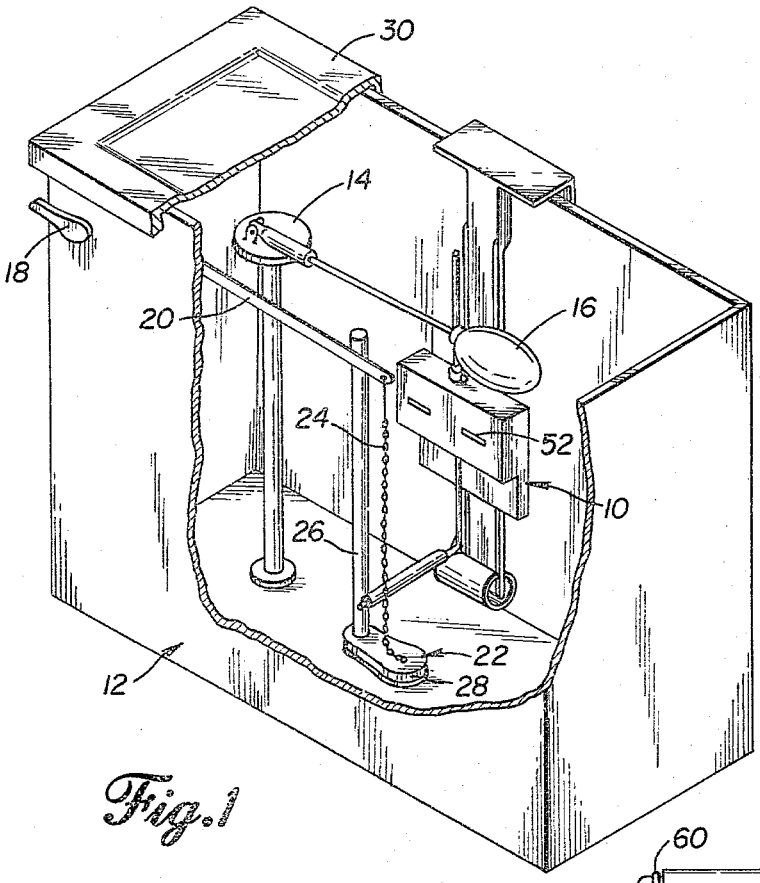
FIG. 1 is an isometric view in partial section of a flush tank having a valve closer installed therein.
Figure 2:
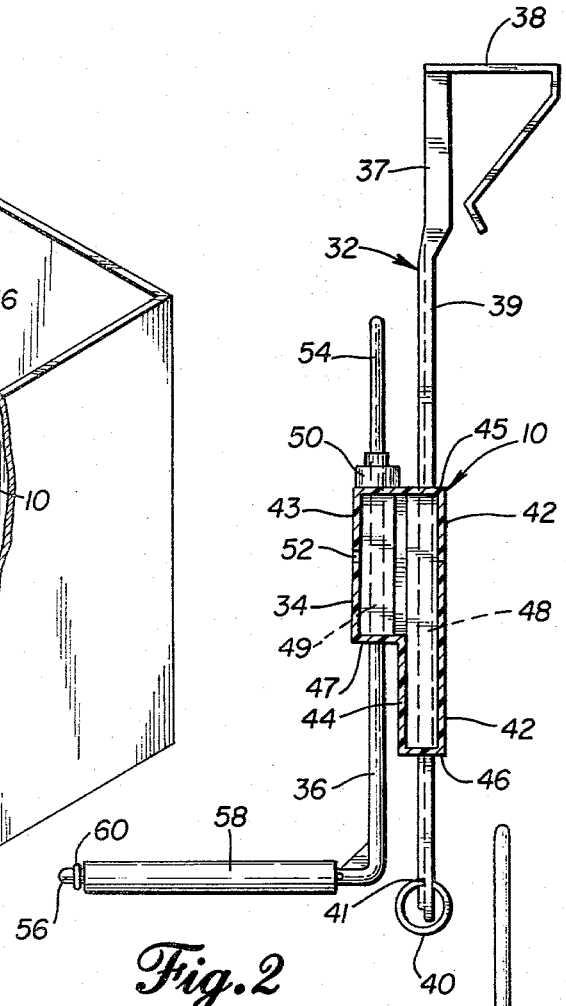
FIG. 2 is a side elevational view in partial section of the valve closer.
Figure 3:
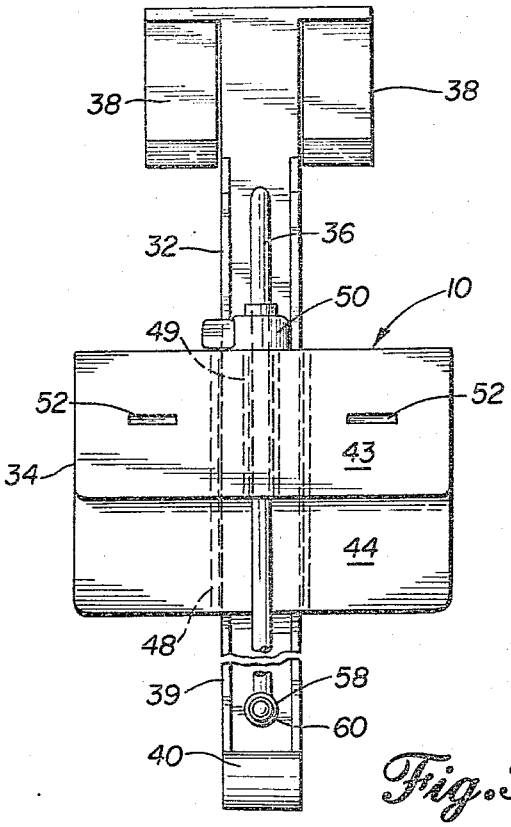
FIG. 3 is a front elevational view of the valve closer.

The flush tank valve closer 10 is best shown in its basic configuration in FIGS. 1, 2, and 3. A toilet flush tank 12 contains well known hardware apparatus including a water inlet valve 14 controlled by a ballcock 16 that moves in response to changing water level in the tank. Flush handle 18 operates an elongated trip lever 20 inside tank 12, and any variety of flush valve such as flapper 22 may be operatively connected to lever 20, for example by actuating member 24. Overflow standpipe 26 is conventionally located adjacent to tank outlet 28, covered by the valve 22. In many tanks, a variety of braces may interconnect standpipe 26 with actuating member 24 when the member is a rod or linkage; however, a flexible chain as illustrated in FIG. 1 ordinarily has no such braces thereon. A lid 30 covers the top of tank 12.

The valve closer 10 includes float guide 32, float 34, and valve actuator rod 36. The float guide may be a flat rod with relatively broad front and rear faces for preventing rotation of the float on the guide rod, in addition to which the flatness of the rod requires little intrusion laterally in to the flush tank. The upper end of the rod is provided with spacer means such as rearwardly offset portion 37 that cooperates with clamp 38 to connect the rod to the top edge of the flush tank. Below offset portion 37 is shank portion 39 upon which float 34 may slide between portion 37 and lower bumper 40, which may be a cylindrical sleeve having an axially split wall that is engaged within groove 41 running transversely across the forward face of the guide rod. Bumper 40 serves both as means to prevent the float from falling off the guide rod if an exceptionally low water level should occur in the flush tank, and as lower spacer means that cooperates with the upper spacer means 37 to hold shank 39 at the required clearance from flush tank wall for free sliding movement of the float.

Float 34 is buoyant and may be a closed or semi-closed container having proper weight to push a normally buoyant flush valve into its seat when contacted by the float or extensions therefrom as the float falls with the falling water level of the flush tank during a flush. It is intended that the applied weight of the float on the flush valve prematurely terminate the flush and retain some of the water in the tank that would otherwise be used before the flush valve becomes seated of its own accord, in response to a normal closing level of water in the tank. If desired, the flush valve may be held open for a normal, full flush by retained hand pressure on flush handle 18, supporting the valve against the weight of the float 34.

The preferred structure of the float includes a planar rear wall 42 and a front wall having an upper portion 43 and lower portion 44, the rear wall being further from the upper than the lower portion of the front wall. Also because of the stepped shape of the front wall, the distance from top wall 45 to bottom wall 46 at the lower edge of walls 44 and 42 is greater than the distance from wall 45 to horizontal wall 47 joining the upper edge of wall 44 to the lower edge of wall 43. A vertical passageway 48, may run adjacently and parallel to wall 42 and receive the shank 39 of the guide rod. A second vertical passageway 49 may run adjacently and parallel to wall 43 and receive actuator rod 36. Both passageways 48 and 49 are preferably sealed from the interior of the float. A locking cap 50 may be rotatably attached to wall 45 over the top passageway 49 in such a position that passageway 49 and a corresponding aperture in the cap are slightly non-coaxial with the axis of the cap but are axially aligned in one position of rotation of the cap, allowing the cap to frictionally retain the rod in the passageway through non-coaxial alignment of the passageway and cap aperture. It will be noted that the lower part of the float is thinner between walls 42 and 44 than the upper part of the float between walls 42 and 43. This allows the rod 36 to operate as will be described below even at levels above the lowest part of the float.

Proper float weight is preferably achieved by placing a predetermined quantity of water in the float. Apertures 52 may be formed in the front wall 43 and rear wall 42 at an appropriate height to create an air pocket in the float above the apertures, thereby assuring the buoyancy of the float. If the float is molded and must be assembled in sections, problems of leakage along the assembly seams are eliminated if the union is along the horizontal plane of the apertures 52.

Valve actuator rod 36 has a vertical arm 54 and a horizontal arm 56 forming an L-shape. Arm 54 extends through passageway 49 and is engaged by locking cap 50 to lock the arm at any desired height of position of rotation. Arm 56 carries a flush valve connecting device such as cylindrical sleeve 58 secured to the arm by an O-ring 60 that prevents the sleeve from sliding off the arm.

Figure 8:
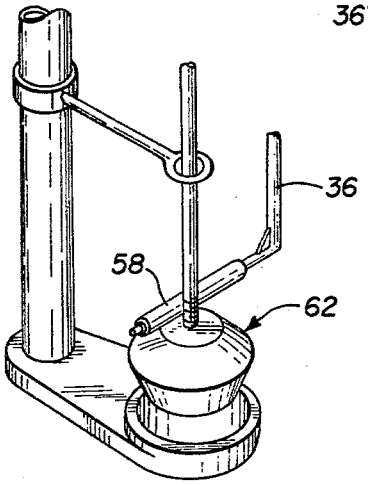
FIG. 8 is an isometric view of a flush valve operated upon by the valve closer.

In its basic configuration, the valve closer 10 is suited for use with conventional flapper valves 22, shown in FIG. 1, and ball closure valves 62, shown in FIG. 8. Clamp 38 is clipped over the front or rear wall of a flush tank 12, locking cap 50 is loosened, and arm 54 is raised, lowered, and turned to bring arm 56 above the valve at a height to be empirically determined. Cap 50 is then tightened. When handle 18 is turned to flush the toilet, valve 22 or 62 is raised to open outlet 28. As the water in tank 12 exits through outlet 28, the interior water level drops and float 34 slides downwardly on guide 32, lowering arm 56 against the top of the ball or flapper valve to prematurely force the valve to close against outlet 28, terminating the flush before the normal amount of water has been used. The exact amount of water saved can be adjusted by altering the height of arm 56 relative to locking cap 50.

With other types of flush valves, slight changes may be required in the rod 36, but the basic operation of the valve closer 10 is unchanged. Special adapters may be used on arm 56 or on the valve to create properly interacting surfaces for the float to push the valve shut as the water level in tank 12 drops, but float 34 continues to rise and fall on its own guide means independent of any specific apparatus belonging to the flush valve. Furthermore, the guide may be moved as required to provide an adequate space for the float and rod to move without interference with the tank or its contents.

Figure 5:
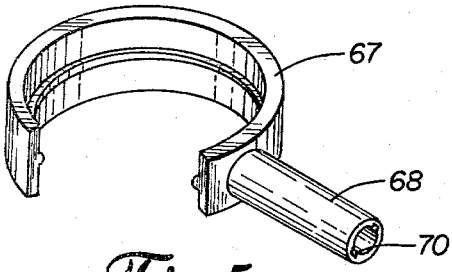
FIG. 5 is an isometric view of a modified valve contact member for use with the rod of FIG. 4.
Figure 4:
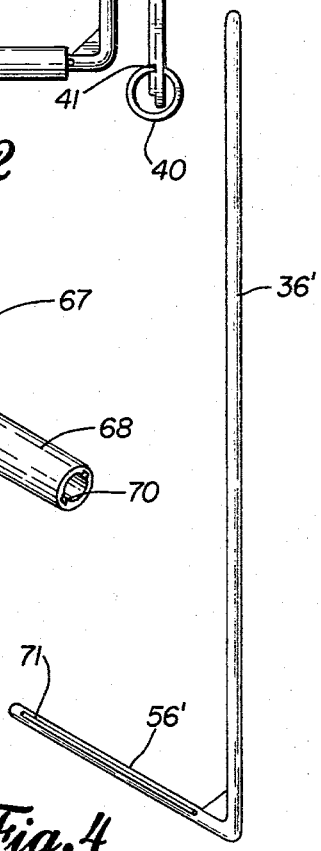
FIG. 4 is an isometric view of a modified valve actuator rod for use with the valve closer.
Figure 9:
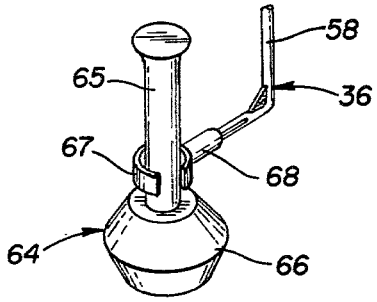
FIG. 9 is an isometric view of another flush valve operated upon by the valve closer.

One common valve 64 shown in FIG. 9 is similar to ball valve 62 except that it has an elongated cylindrical portion 65 extending upwardly from the ball 66 at the bottom of the valve. The C-shaped adapter 67 of FIG. 5 is best suited for use with this valve. Rod 36 may be modified as shown in FIG. 4 as rod 36' by removing O-ring 60 and sleeve 58 from arm 56', shortening arm 56' if required, and inserting arm 56' into sleeve 68 attached to the side of the adapter 67. The interior of sleeve 68 may have a keyway 70 that engages rib 71 on arm 56' to hold the adapter in a predetermined position of rotation on the arm. The adapter 67 improves the reliability of the valve closer 10 when used with valve 64, as the C-shaped portion of the adapter will not slip when pressing downwardly on the lower ball portion 66 of the valve.

Figure 6:
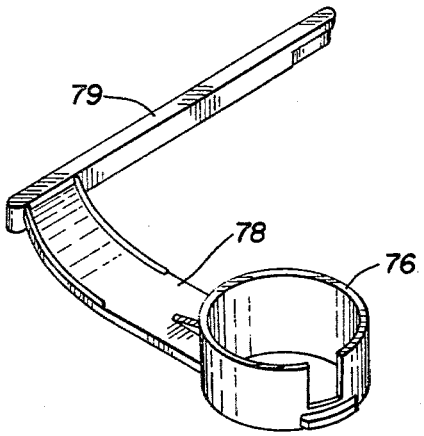
FIG. 6 is an isometric view of an adapter for use with the valve shown in FIG. 10.
Figure 10:
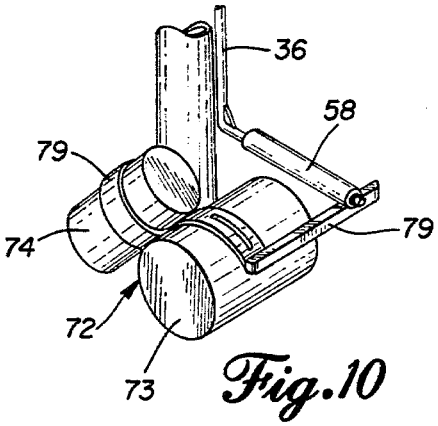
FIG. 10 is an isometric view of another flush valve operated upon by the valve closer.

Another common valve 72 of the flapper valve type has a lower cylinder 73 and an upper, transverse cylinder 74, as shown in FIG. 10. Ring shaped adapter 76 of FIG. 6 is engaged with cylinder 74 so that curved support shank 78 rests against and follows the approximate contour of cylinder 73, and arm 79 is approximately parallel to the axis of cylinder 73 and extends beyond the end of this cylinder. Valve closer 10 may then be used in its basic configuration with sleeve 58 contacting arm 79 at the appropriate time to close valve 72.

Figure 7:
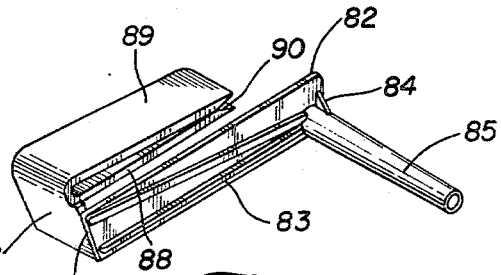
FIG. 7 is an isometric view of an adapter for use with the valve of FIG. 11.
Figure 11:
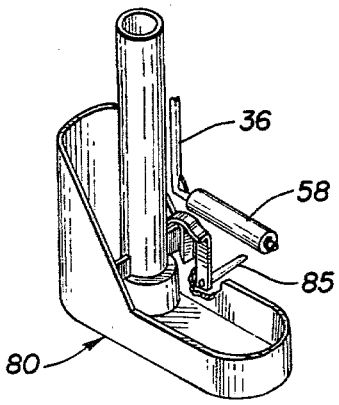
FIG. 11 is an isometric view of another flush valve operated upon by the valve closer.

Another type of valve 80, shown in FIG. 11, may be equipped with adapter 82 of FIG. 7. The adapter has a clip portion, an arm portion, and a shank portion interconnecting the clip and arm. Shank 83 is an elongated planar member with a free end 84 having arm 85 extending therefrom normal to the plane of the shank. The opposite end 86 has a shoulder 87 formed thereon and extending on the opposite side of the plane of the shank from arm 85. From shoulder 87 depend cooperating clip members 88 and 89 in planes normal to the plane of shank 83 and approximately parallel to the longitudinal axis of the shank. Slot 90 is created between members 88 and 89 for the purpose of engaging a surface of valve 80. A slight gap of, for example, one-sixteenth inch separates clip members 88 and 89 from the plane of shank 83 and separates shank 83 from the plane of the closest clip member so that the clip portion may engage a first wall of valve 80 and the shank portion 83 may overlap a second wall transverse to the first wall, and support arm 85 on the exterior of the valve 80, as shown in FIG. 11. The valve closer 10 may then operate in its basic configuration with sleeve 58 acting on arm 85 to close the valve.

Figure 12:
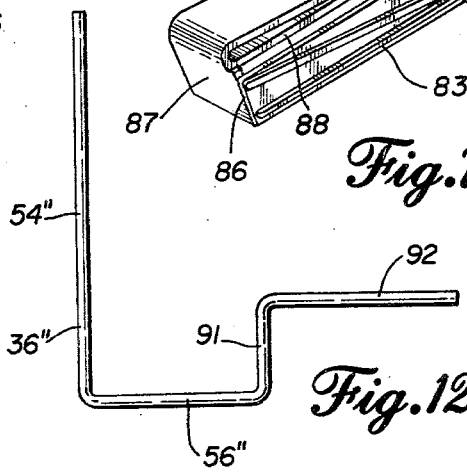
FIG. 12 is a side elevational view of a modified valve actuator rod for use with the valve closer.

From the above described operation of the valve closer 10, it will be understood that the various adapters merely improve the reliability with which the valve closer acts on some valves. The basic valve closer 10 may be supplied with any or all of the described modifications as a particular situation may require. If desired, the rod 36' of FIG. 4 may be distinct from the rod 36 shown in FIGS. 1—3 so that little mechanical skill will be required if the C-shaped adapter of FIG. 5 is to be used. Another modified actuator rod 36" is shown in FIG. 12 to include vertical arm 54" similar to arm 54, and horizontal arm 56" having vertically upwardly extending portion 91 with a relatively higher horizontal arm 92 at the free end thereof. Rod 36" may be used whenever it is necessary or desired to close a valve from a higher position than would be possible with rod 36. Other combinations and variations of actuator rods, and adapters could be used.

Figures 13, 14:
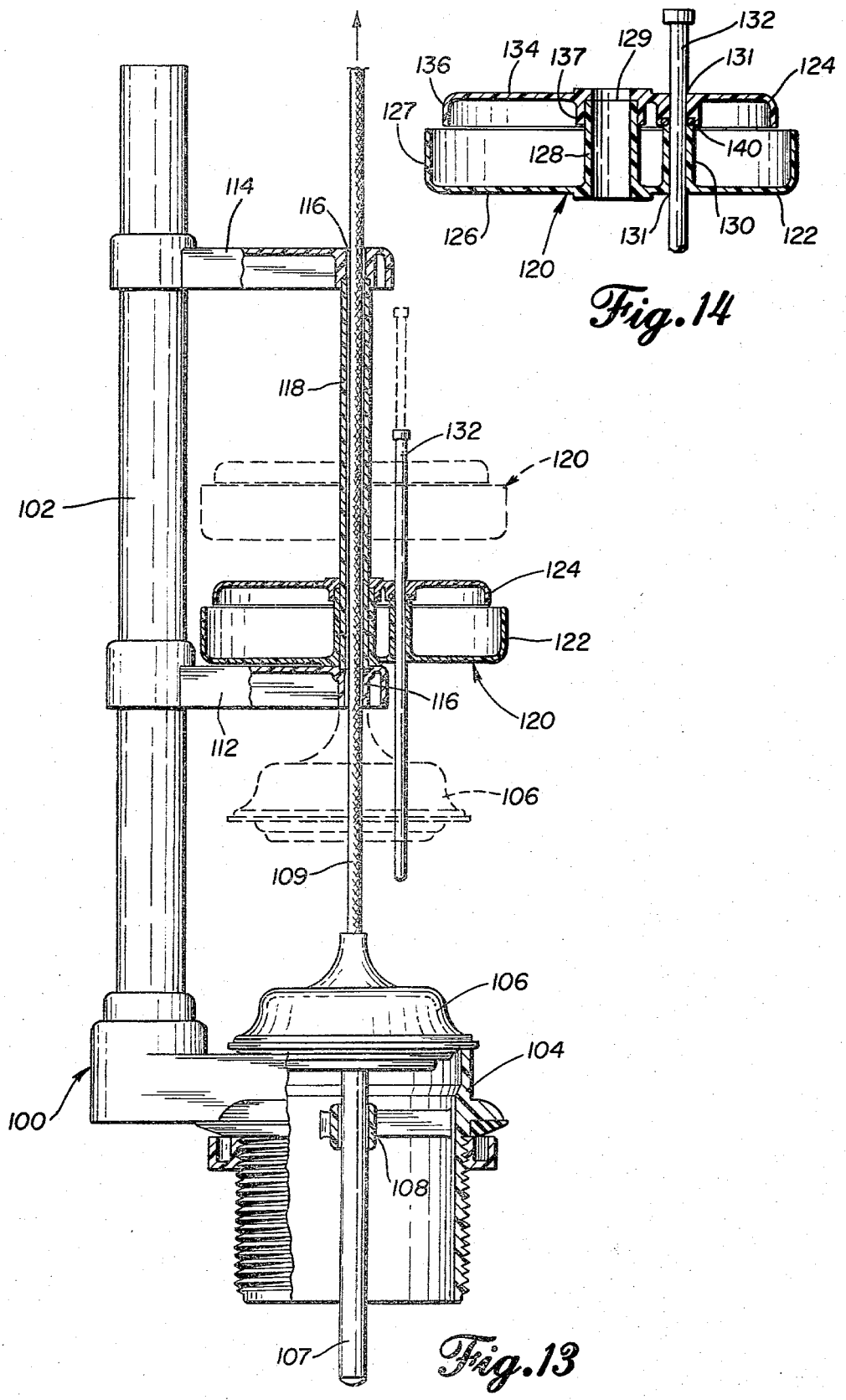
FIG. 13 is a side elevational view in partial section of a flush valve assembly having a modified version of the valve closer installed thereon.
FIG. 14 is an enlarged vertical cross-sectional view of the valve closer of FIG. 13.

In many instances it is desirable or necessary to install a new flush valve in a flush tank. Persons making such a change may prefer to add a water saving device that is incorporated in the valve, rather than to add valve closer 10 to an existing flush valve. For this purpose, a special valve closer as seen in FIGS. 13 and 14 has been created to work in combination with a pre-existing flush valve assembly of proven design from the prior art. Such a valve assembly is manufactured by 20th Century Products and is disclosed in U.S. Pat. No. 2,904,794. As shown in FIG. 13, the valve assembly 100 includes standpipe 102 that is joined to a valve seat 104. Stopper means such as valve float 106 seals the valve when in the position shown in solid lines in FIG. 13, but may be raised to the position shown in dashed lines when the valve is open. On the bottom of the valve float is a spindle 107 that passes through guide 108 fixed in the throat of the valve seat. A flexible cord 109 is connected to the top of the valve float 106 and extends upwardly to a conventional trip lever 20, FIG. 1, for pulling the valve float into the dashed position of FIG. 13. Lower spacer arm 112 guides the cord 109 at a fixed distance from the standpipe and also prevents the valve float from being pulled to such a height that spindle 107 would be pulled free of guide 108. Other advantages of the flush valve 100 are taught in U.S. Pat. No. 2,904,794, incorporated by reference herein.

To the pre-existing structure of the flush valve 100 is added an upper arm 114 identical to lower arm 112. Each of these arms has an aperture 116 through the outer end thereof, and the apertures 116 are axially aligned with each other and with the attachment point of cord 109 on valve float 106, for example one and one-half inches from standpipe 102. Valve float 106 may have a radius of approximately one and three-eighths inches, with the result that the valve float will always have adequate clearance from standpipe 102. The apertures 116 have a diameter sufficiently large to allow cord 109 to pass without interference, and the apertures are flared outwardly or otherwise enlarged at their upper and lower ends in arms 112 and 114 to create a suitable space in which to receive the tip of hollow tube 118. The upper tip of tube 118 is engaged within the lower end of the aperture in arm 114, while the lower tip of the tube may be engaged within the upper end of the aperture in arm 112. Alternatively, the tube 118 may have tapered ends to fit within apertures of uniform diameter, or the tube may be held between the arms 112, 114 against axial movement but without engagement in the apertures. Tube 118 corresponds in general function to float guide 32 of valve closer 10, except that tube 118 is clamped to the standpipe, for example through the air or arm 114, rather than to the side of the flush tank.

Slidably mounted on tube 118 is float 120, which is preferably in the form of a cup shaped lower portion 122 and an inverted cup shaped upper portion 124. Lower portion 122 includes bottom wall 126 and annular side wall 127. Upstanding tube 128 rises from bottom wall 126 and defines a passageway 129 of sufficient diameter to allow tube 118 to pass freely therethrough. A second upstanding tube 130 rises from bottom wall 126 and defines a passageway 131 of sufficient diameter to accomodate actuator rod 132 therein. The structure is best shown in FIG. 14.

Upper cup portion 124 includes top wall 134 and annular side wall 136. Depending from the bottom of wall 134 is tube 137 having an axial height at least great as wall 136 and further defining passageway 129. Flange 137 mates with flange 128 to join float portions 122 and 124, preferably with the lower end of wall 136 at the approximate relative vertical position as the upper end of wall 127. A second tube 138 depends from wall 134 and further defines passageway 131 for rod 132. Tube 138 has an axial height at least as great as wall 136 and mates with tube 130 to accomodate rod 132. A resilient device such as O-ring 140 having an inner diameter slightly smaller than the outer diameter of rod 132 fits around passageway 131, for example in an annular recess at the inner base of tube 138 where the ring is held firmly in place by both tubes 138 and 130.

Lower cup 122 may have the following approximate dimensions: outer diameter of three inches; inner diameter of two and seven-eights inches; outer height of wall 127 of one-half inch; and inner height of wall 127 of seven-sixteenths inch. Cup portion 124 may have an outer diameter of two and five-eights inches; inner diameter of two and one-half inches, height at the outer side of wall 136 of one-quarter inch; and height inside wall 136 of three-sixteenths inch. It will be understood that if passageway 129 defines the axial center of the float 120, there is an annular gap of approximately one-eighth inch between the closest portions of walls 127 and 136. When the float 120 is used in a flush tank, the lower portion 122 will be filled with water, while the upper portion 124 will retain trapped air. Because tubes 137 and 138 extend downwardly at least as far as wall 136, there is no problem with air leaks altering the buoyancy of the float.

Rod 132 is axially moveable in passageway 131, although O-ring 140 tightly holds the rod against unwanted motion. Passageway 131 is offset from passageway 129 by a sufficient distance to provide clearance between rod 132 and arms 112 and 114. The length of the rod may be slightly greater than the distance between arms 112 and 114 so that the rod itself will prevent float 120 from rotating on tube 118 into a position where the rod would interfere with the arms.

In operation the valve closer as seen in FIGS. 13 and 14 performs much like closer 10. The float is ordinarily buoyant and remains in an uppermost position against arm 114, which is below or close to the full water level of the flush tank. The flush valve is actuated as previously described, with valve float 106 being raised to a position adjacent to the lower side of arm 112. As the tank water pours through valve seat 104, the level of water in the flush tank will drop and float 120 will lower on tube 118 with the dropping water level. The lower end of rod 132 will contact the top surface of valve float 106 and the weight of the float 120 will force the valve to close prematurely. The relative height of rod 132 can be altered with respect to float 120 by axially moving the rod to the desired height, thereby adjusting the amount of tank water that will be allowed to exit before the valve is closed.

I claim:

1. A flush valve closer for use in a toilet flush tank having a water outlet opening and valve stopper means seatable in the opening when the toilet is not being flushed, the stopper means being raisable from the opening to initiate a flush and allow water to exit the tank through the opening, the stopper being automatically lowerable to seal the opening in response to a predetermined lowered closing level of water in the tank, comprising:

(a) a stationary float guide rod having means for attachment to the flush tank wall at the upper end thereof, first spacer means near the upper end of the rod and second spacer means near the lower end of the rod for maintaining the intermediate portion of the rod at a predetermined distance from the flush tank wall;

(b) a buoyant float elongated on one horizontal dimension mounted adjacent said flush tank wall on said intermediate portion of the guide rod for spacing said float from said stopper and for available sliding movement between said first and second spacer means and horizontally offset from the stopper means for slidable movement with respect to the rod between an upper position, wherein the float is not applying its weight against the stopper means, and a lower position, wherein the float is applying its weight against the stopper means to force the stopper means into sealing relationship with the outlet opening before the water falls to said predetermined closing level during a flush; and (c) actuator means extending outwardly from said float for transmitting the weight of the float against the stopper means when the float is in said lower position.

2. The flush valve closer of claim 1, wherein said buoyant float comprises a tank having an upper portion for containing air and a lower portion for containing water, the float tank having an opening in its side at a level defining the boundary between the upper and lower portions for admitting water into the float tank to the level of the opening, and wherein a seam line between the upper and lower portions extends in the horizontal plane through said opening.

3. The flush valve closer of claim 2, wherein said float tank further comprises a top wall and a bottom wall, the top wall having a first passageway formed therein with integral depending walls extending at least to said boundry between the upper and lower portions for preventing air loss through the passageway, the bottom wall having a second passageway formed therein in axial alignment with the first passageway, the first and second passageways receiving said float guide rod.

4. The valve closer of claim 1, wherein said buoyant float is non-centrally mounted on the guide rod with respect to the horizontal dimension normal to said elongated dimension.

5. The flush valve closer of claim 1, wherein said float further comprises an actuator rod passageway formed therein non-centrally with respect to the horizontal dimension normal to said elongated dimension; and said actuator means comprises an L-shaped actuator rod having a vertical arm received in said actuator rod passageway and a horizontal arm extending from the vertical arm to operatively contact the tank stopper.

6. A flush valve closer attachment for use with a toilet flush tank of the kind having water therein and a water outlet opening in the bottom thereof and a flush valve seatable in the opening, the valve remaining seated in the opening when the toilet is not being flushed and normally remaining buoyantly suspended above the opening in response to the forceful raising of the valve to initiate a flush, until the water level in the tank drops from a normal pre-flush level to a predetermined valve-closing level, comprising:

(a) a float guide rod having a clip on the upper end thereof for engagement with the lip of the flush tank for selective placement thereon, the guide rod extending downwardly into said tank below the normal preflush level of the water in the tank and having a fixed position with respect to the clip;

(b) a buoyant float mounted slidably and non-centrally on said guide rod, the float being downwardly moveable with respect to the guide rod between an upper position when the water in the tank is at pre-flush level, and a lower position when the water falls below pre-flush level in the course of a flush, the float being defined in horizontal cross-section by a major dimension for width and a minor dimension for thickness wherein the mounting of the float on the guide rod is non-central with respect to the minor dimension; said float being mounted adjacent the wall of the tank with said non-central guide rod mounting portion being located in the portion of the float adjacent the tank wall;

(c) a valve actuator rod adjustably connected to the float and extending outwardly therefrom for selective positioning to contact the flush valve and transmit force of the downwardly moving float during a flush to push the flush valve into seated engagement with the water outlet opening before the water in the flush tank reaches the predetermined valve-closing level.

said valve actuator rod comprises vertical arm, a horizontal arm, a horizontal arm connected to the lower end of the vertical arm to form an L- shape, and a flush valve contact member attached to the horizontal arm.

7. The flush valve closer of claim 6, wherein said float comprises:

(a) a top wall, a planar rear wall vertically depending therefrom, a first bottom wall portion extending from the base of the rear wall and terminating at a predetermined distance from the rear wall, a lower front wall portion extending vertically upwardly from the first bottom wall portion at said predetermined distance from the rear wall and terminating at less than the height of the top wall, as second bottom wall portion extending from the top of the lower front wall and terminating at a greater distance from the rear wall than said predetermined distance, an upper front wall portion connecting the second bottom wall portion to the top wall, and a pair of end walls closing the sides of the float;

(b) the float having a horizontal cross-section in the shape of a rectangle with the rear and front walls forming the longer sides thereof;

(c) the lower portion of the float between the rear wall and lower front wall portion being thinner than the upper portion between the rear wall and upper front portion and having a guide rod passageway extending vertically therethrough for receiving said float guide rod in slidable relation;

(d) the upper portion of the float between the rear wall and upper front wall portion being shorter in vertical height than said rear wall and having a vertical actuator rod passageway therein; and (e) locking means for retaining said actuator in a selected position within the actuator rod passageway.

8. The flush valve closer of claim 6, wherein said float guide rod comprises:

(a) an elongated vertical shank for slidable engagement with said float, the shank having forward, rearward, and side faces with the forward and rearward faces being relatively broader than the side faces;

(b) the upper end of the shank having upper spacer means on the rearward face thereof and the lower end of the shank having lower spacer means on the rearward face thereof;

(c) said clip depending from the top of the guide rod opposite to said rearward face thereof and cooperating with said upper spacer means to hold the guide rod against a wall of a flush tank, the upper and lower spacer means holding the intermediate portion of the shank at a clearance from the wall of the flush tank for free slidable movement of the float on the shank.

9. The flush valve closer of claim 6, wherein said float further comprises a guide rod passageway formed vertically therein and offset from the center of said minor dimension of the float; a valve actuator rod passageway formed in the float; and said valve actuator rod vertical arm being receivable in said valve actuator rod passageway.

10. The valve closer of claim 9, wherein said flush valve contact member comprises a sleeve loosely mounted on said horizontal arm for rotation thereon.

11. The valve closer of claim 9, wherein said flush valve contact member comprises a C-shaped portion having means thereon for attaching the portion to the horizontal arm and retaining the portion in a substantially horizontal plane, the open center of the C-shaped portion allowing portions of the flush valve to pass freely therethrough to initiate a flush.

12. The valve closer of claim 9, further comprising a flush valve adapter clip attachable directly to a flush valve and having a horizontal arm thereon for intermittent contact by said flush valve contact member to push the flush valve into seated engagement with the water outlet opening.

* * * * *